United States Patent [19]

Smith

[11] Patent Number: 4,534,156

[45] Date of Patent: Aug. 13, 1985

[54] BOX FILLING APPARATUS

[75] Inventor: Gary T. Smith, Exeter, Calif.

[73] Assignee: Pennwalt Corporation, Philadelphia, Pa.

[21] Appl. No.: 577,009

[22] PCT Filed: Jun. 7, 1982

[86] PCT No.: PCT/US82/00773

§ 371 Date: Feb. 6, 1984

§ 102(e) Date: Feb. 6, 1984

[87] PCT Pub. No.: WO83/04401

PCT Pub. Date: Dec. 22, 1983

[51] Int. Cl.[3] ..... B65B 5/10

[52] U.S. Cl. ..... 53/503; 53/247; 53/260; 53/506; 141/176; 222/56

[58] Field of Search ..... 53/503, 502, 260, 255, 53/245, 247, 536, 535, 55, 506, 69; 141/168, 176, 182; 222/533, 535, 536, 56; 193/17

[56] References Cited

U.S. PATENT DOCUMENTS

| | | | |
|---|---|---|---|
| 2,381,505 | 8/1945 | Lindholm | 222/56 |
| 2,430,407 | 11/1947 | Nelson | 198/526 X |
| 2,647,670 | 8/1953 | Cox | 53/536 |
| 2,880,763 | 4/1959 | Warner | 141/176 X |
| 2,899,783 | 8/1959 | Otto | 53/502 |
| 2,962,172 | 11/1960 | Fath et al. | 198/505 X |
| 3,336,724 | 8/1967 | Tarukawa | 53/503 |
| 3,693,774 | 9/1972 | Meitl | 193/5 X |
| 4,085,869 | 4/1978 | Neier | 222/533 X |
| 4,372,730 | 2/1983 | Ladt | 222/536 X |

*Primary Examiner*—James F. Coan

[57] ABSTRACT

The invention is applied to an apparatus for filling storage boxes with lemons or other articles. The articles are first diverted from a conveyor into a measuring and collecting bin. When articles fill the bin to a level which will fill a box beneath the apparatus, a photoswitch stops the conveyor to prevent overfilling of the bin. The photoswitch also tilts a chute at the bottom of the bin whereby the entire contents of the bin are emptied into the box. Although the level of articles in the bin falls below the beam which operates the photoswitch, an internal time delay in the photoswitch holds the conveyor in stopped position and it also holds the chute in tilted position until sufficient time has passed for the box to be filled. Immediately thereafter, the chute is returned to upright position, the conveyor is restarted, and an unfilled box takes the position of the filled box.

12 Claims, 5 Drawing Figures

BOX FILLING APPARATUS

BACKGROUND OF THE INVENTION

This invention relates generally to apparatus for filling boxes and other containers, and specifically to an apparatus for filling storage boxes with lemons.

Manual labor has been required to pack lemons from a conveyor belt into storage boxes. The present invention provides a machine to transfer a measured volume of lemons or other articles from a conveyor belt to a storage box, at speeds of about 150 boxes per hour, more or less, thereby reducing the labor cost of this operation.

According to the invention, apparatus is provided for filling a box with articles, e.g. lemons, from a movable conveyor. Such apparatus comprises means for driving the conveyor, with a bin positioned adjacent the conveyor and provided with a top opening for receiving the articles. Also provided is a diverter for directing the articles from the conveyor into the bin via its top opening. The bin also has a bottom outlet. A chute, hinged to the bin, is movable between a first position which closes the bin outlet and a second position which opens the bin outlet and conducts the discharging articles to the box. A pneumatic cylinder serves to move the chute between such first and second positions. In addition, a photoswitch or photocell device, which is connected to the conveyor driving motor and to the pnuematic controls, responds to the filling of articles into the bin to a predetermined level by controlling such motor and such pneumatic control so as to regulate both the feeding of the articles to the bin and the discharge of articles from the bin.

The photoswitch detects the level of articles in the measuring and collecting bin and, when the bin is full as desired, the photoswitch de-energizes the conveyor motor, thus stopping the conveyor to prevent overfilling the bin. The photoswitch also energizes a solenoid for the pneumatic cylinder which lowers the chute connected to the bin, thereby delivering the lemons to their storage boxes. The photoswitch is adjustable so as to be responsive at one of various levels of articles within the bin, in order that the desired volume of fruit will be consistently transferred to each box.

An internal time delay of the photoswitch maintains the positions of the conveyor, the bin, and the chute as the transfer of articles is in progress; and, after an appropriate number of seconds has passed, conveyor belt movement is resumed and the chute is returned to its original, upright position. In addition, limit switches are provided to ensure that the pneumatic solenoid will not be energized to lower the chute unless an empty box is in position to receive the contents of the bin. Further controls are provided to control movement of a filled box along a separate box conveyor to another location, also movement of an empty box into the place of the filled box.

PRIOR ART

Various components of the apparatus disclosed herein may be found in the prior art. U.S. Pat. No. 3,693,774 discloses a mobile fruit harvester having a collection bin and a chute pivotally mounted on the bin; and various patents such as U.S. Pat. Nos. 2,381,505; 2,430,407 and 2,962,172 disclose control elements such as photocells for maintaining levels and handling materials. The complete combination of the present invention is disclosed herein, and is submitted to advance the art over these prior art devices by providing a labor saving apparatus for a specific purpose which is of simple, economical and novel construction.

DESCRIPTION OF THE PREFERRED EMBODIMENT

Figure 1:
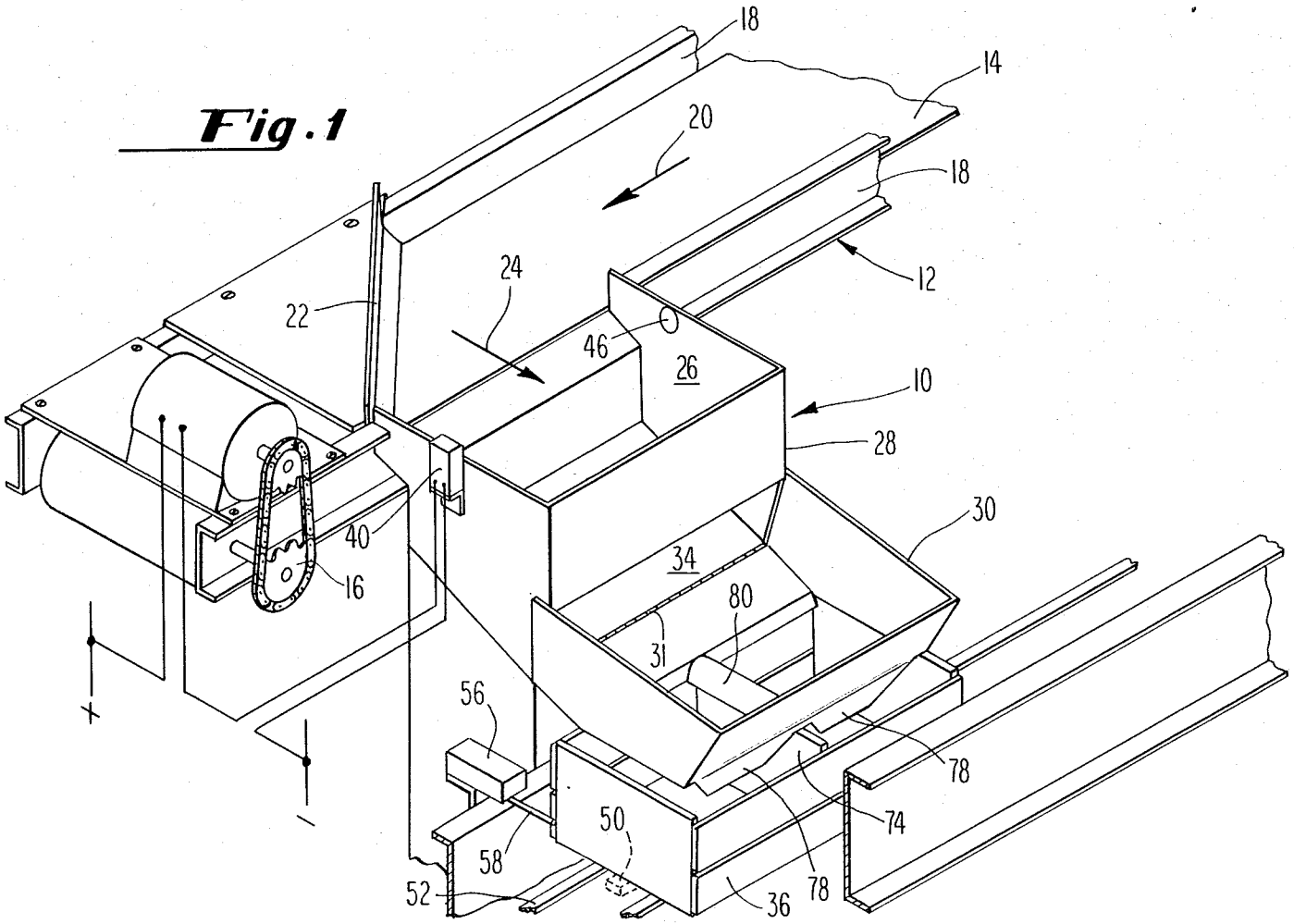
FIG. 1 is an isometric view of an apparatus embodying the present invention.

Referring to the drawings in detail, especially FIG. 1, the box filling apparatus of the invention is designated generally by the reference numeral 10, and shown mounted to one side of a horizontally disposed conveyor 12. The conveyor 12 preferably includes a continuous belt 14 driven by pulleys (not shown) which are, in turn, rotated by a motor-driven chain and sprocket system 16, all carried by a pair of spaced channel members 18.

With the belt 14 moving in the direction of the arrow 20, lemons or other articles carried thereon are conveyed toward a diverter bar 22. Although shown mounted at a 45 degree angle to the direction of the arrow 20, the diverter bar 22 is adjustably secured by suitable means, thereby permitting selective angular positioning to achieve optimum article movement. Upon contact with the diverter bar 22, the conveyed articles are directed or diverted laterally from the direction of arrow 20 to the direction of the arrow 24, whereupon the articles are discharged to one side of the belt 14 into the top opening 26 of a collection bin 28, as best seen in FIG. 3.

The bin 28 serves as a hopper for the temporary storage of articles, and also as a measuring utensil which has at least the same internal volume as the box 36 to be filled. With suitable controls, bin 28 may be filled up to a level at which it will hold the same number of lemons, or volume of articles, as the box 36.

Figure 3:
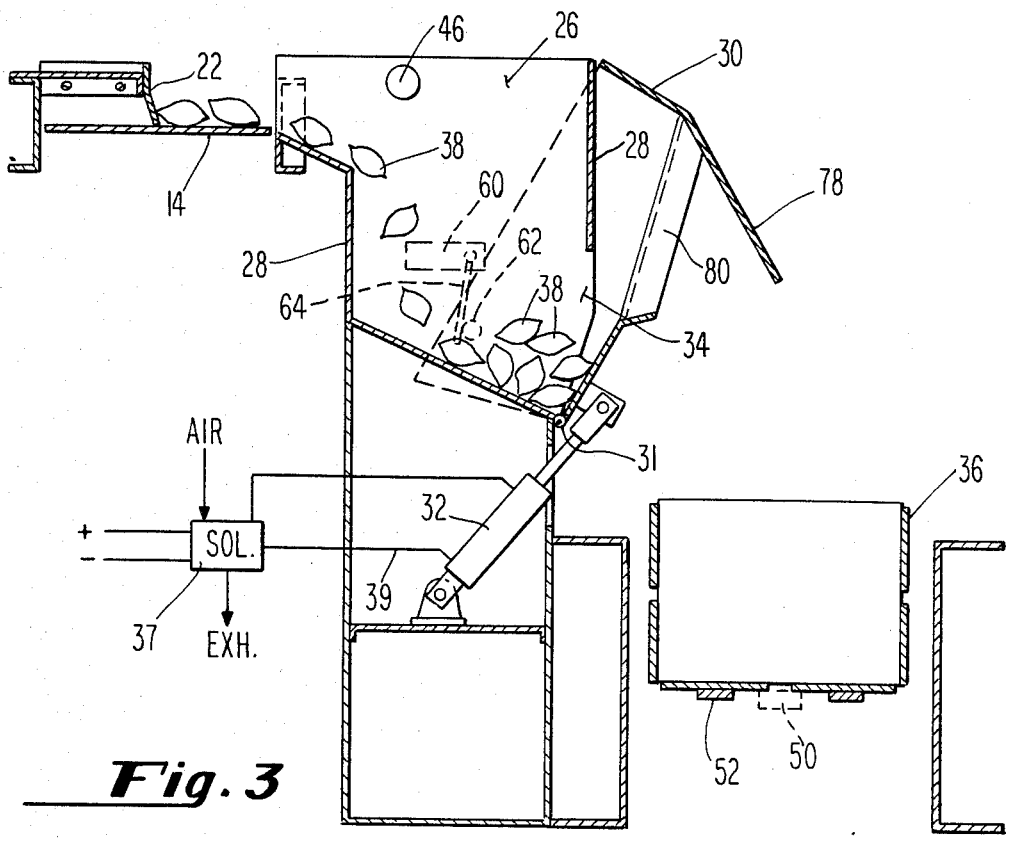
FIG. 3 is a vertical sectional view taken transversely through the apparatus of FIGS. 1 and 2.
Figure 4:
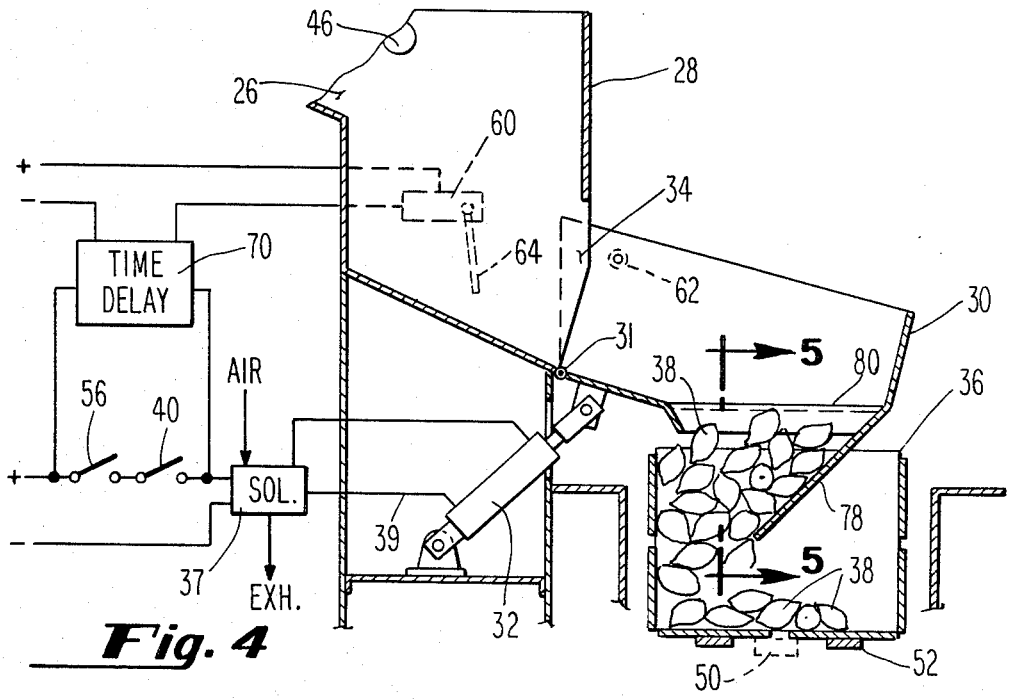
FIG. 4 is a vertical sectional view similar to FIG. 3, taken along line 4—4 of FIG. 2.

As shown in FIGS. 3 and 4, the apparatus 10 has a movable chute 30 which is hinged at 31 to the bin 28 for movement between upper and lower positions. A pneumatic cylinder 32 normally holds the chute 30 upright in its upper position, as shown in FIG. 3, wherein the chute closes a bottom opening 34 of the bin and thus prevents the flow of articles from the bin to the box 36 disposed beneath it. In response to energization, solenoid valve 37 controls the flow of pressurized air through suitable tubing 39 between the pneumatic cylinder 32, exhaust, and a source of pressurized air. Solenoid valve 37 has its exhaust port closed, and it also has an internal switch which is normally closed to maintain the chute 30 in its upper position.

A time delay switch 60 is shown in FIG. 3. As shown, a stub 62 mounted on the right side of the chute 30 engages the switch lever 64 in the normally open position of the switch. In FIG. 3, the numeral 38 designates lemons being diverted from the belt 14 into the bin 28 and held therein by a raised chute 30.

Referring to FIGS. 1 and 4, photocell device or photoswitch 40 initiates the lowering of the chute 30 upon energization of the solenoid of valve 37, with pressurized air again flowing through tubing 39, but this time the exhaust port is open. For this purpose, photoswitch 40 completes a series circuit including a limit switch 56.

In closed position, switch 56 indicates the presence of a box 36 in position to be filled. In such position, the box 36 to be filled biases the switch lever 58 to the left, thereby closing limit switch 56. The chute 30 is in lowered position in FIG. 4 to discharge all of the lemons 38 in the bin 28 to the box 36. When the bin 28 is filled to a predetermined level it has the same volumetric capacity as the box 36; the bin 30 is completely empty when the box 36 is filled; and the filling cycle may be restarted after the apparatus 10 is reset to original position.

The lowereing of the chute 30 to its FIG. 4 position disengages the stub 62 from the switch lever 64, thereby closing the time delay switch 60 and energizing time delay relay 70. By this action, relay 70 closes a circuit to solenoid valve 37, which circuit is parallel to at least photoswitch 40 and optionally parallel to switch 56 also, as shown, thereby keeping solenoid valve 37 energized for so long as is necessary to empty the contents of the bin 28 and the chute 30. Time delay relay 70 is a commercially available device which may be adjusted by the user for a time delay of up to 16 seconds, as needed. By this arrangement, solenoid valve 37 will not be prematurely de-energized by the photoswitch 40 when the discharging lemons fall out of the path of the beam 42, whereby time delay relay 70 maintains the chute 30 in lowered position until all of the lemons 38 have been discharged to the box 36.

Movement of the conveyor belt 14 by the motor of the belt drive system 16 is controlled by the electrically energized photocell device or photoswitch 40. The photocell device emits a beam 42 of light in the direction of the arrows 44 in FIG. 2 toward a mirror 46. When the path of the beam 42 is unobstructed, the beam travels across the top opening 26 of the bin 26, strikes the mirror 46 and is reversed to take a path in opposite direction toward a receiving eye on the photocell device 40. For the sake of brevity, the emitter and receiving eye of the photocell device 40 are neither shown nor described in detail since they (and the other electrical components employed herein) are well known, commercially available elements which are commonly used in devices for detecting the presence of an object along a beam path.

In the apparatus 10 of the present invention, the photocell device 40 responds when the bin 28 is filled to a level which will completely fill one box. The filling of the bin to such level is indicated by the presence of one or more articles in the path of beam 42, for example, at the level of the top opening 26, whereupon the motor of the belt driving system 16 is de-energized to prevent overfilling. By this arrangement, the belt 14 carries articles toward the diverter bar 22 and the bin 28 only when there is room in the bin for more articles, and not when it is filled.

When the bin 26 is filled, the photocell device 40 actuates the solenoid valve 37, which in turn initiates the action of the pneumatic cylinder 32 to lower the chute 30 to its FIG. 4 position, whereupon articles flow out of the bottom opening 34 of the bin 28, through the chute 30 and into the box 36.

As articles are discharged from the bin 28, the level of articles therein falls and the beam 42 is no longer obstructed. In order to ensure that the photocell device 40 does not interrupt the discharge process in response to the falling level of articles, an interval a time delay of the photocell device holds it in actuating condition for at least the number of seconds required to empty the bin 28.

The actuating action of the photocell device 40 may be conditioned upon an empty box 36 being present for filling beneath the apparatus 10, such conditioning being effected by means of an optional weight switch 50 in the actuating circuit. The weight switch 50 may be installed under the box conveyor 52 at the filling location. Switch 50 is preferably connected in the actuating circuit to be normally closed when an empty box 36 is in position to be filled, and to open the circuit if an empty box is not in such position.

The box conveyor 52 may comprise motor-driven belts, or any other suitable powered system for conveying a series of empty boxes 36 to filling position beneath the apparatus 10, and for moving the filled boxes away from the apparatus to another location. In order to provide the box conveyor 52 with box positioning means, the limit switch 56 may be employed to de-energize the motor driving the box conveyor 52 when the switch lever 58 is engaged by a box 36. Subsequently, the return of the chute 30 to upright, FIG. 3 position after a time delay ensures completion of the discharge from the bin; and stub 62 engages lever 64 of switch 60. The switch 60 and the time delay switch cooperate to energize the box conveyor 52 until an empty box is again indexed in a position to be filled.

Figure 2:
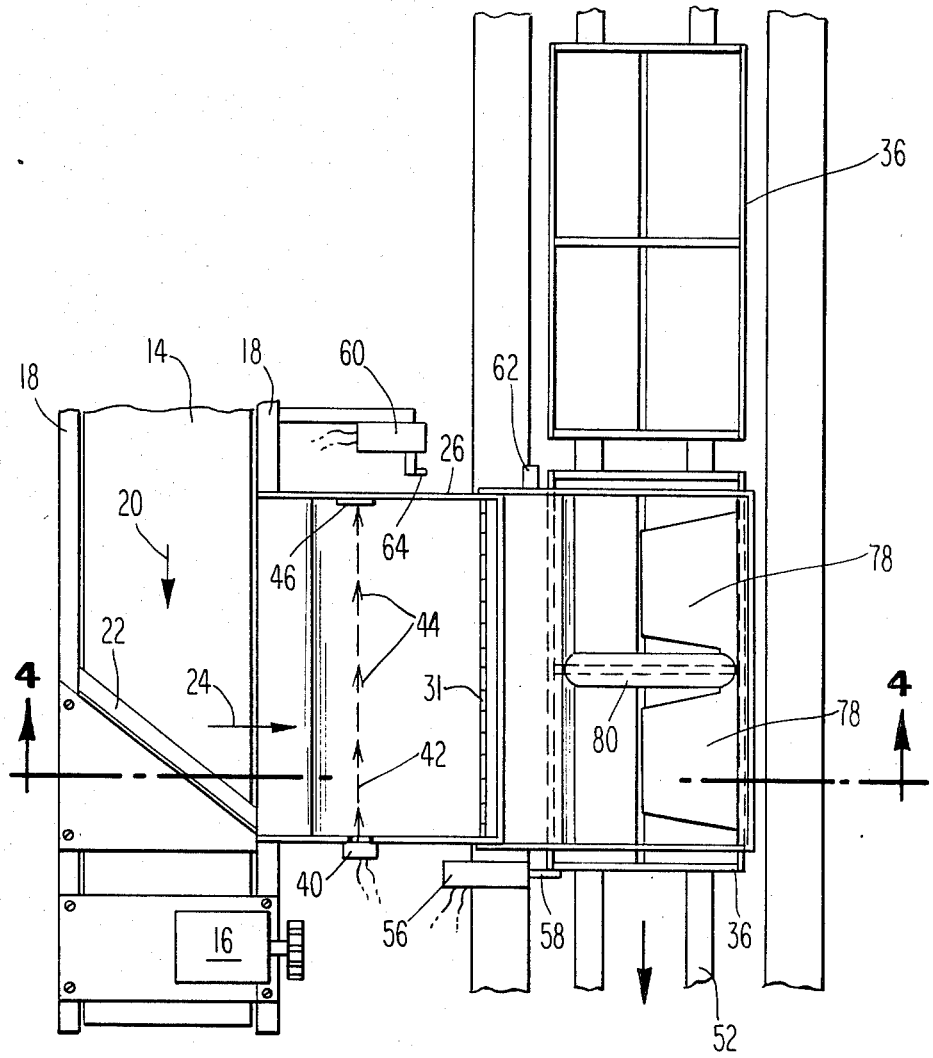
FIG. 2 is a plan view of the apparatus of FIG. 1.
Figure 5:
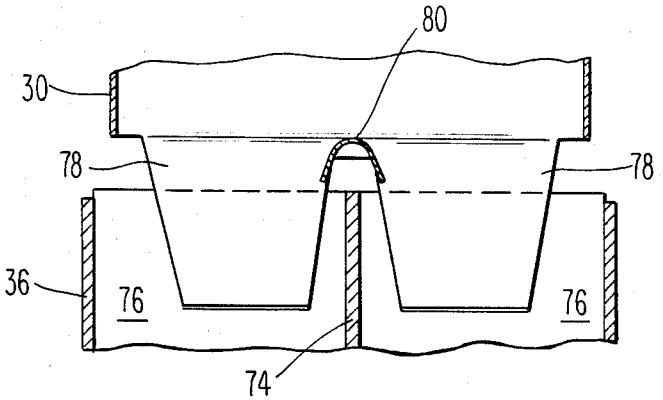
FIG. 5 is a fragmentary view, partly in elevation and partly in vertical section, showing a portion of the apparatus within a box to be filled.

Referring now to FIGS. 2 and 5, it will be seen that box 36 has a center partition 74 dividing its interior into two compartments 76. To facilitate filling of such a box, the discharge portion of chute 30 is bifurcated to provide two discharge funnels 78 connected by a divider 80 which saddles the partition 74. This provision conducts the discharging articles to the compartments 76 and protects lemons and other delicate articles against damage form striking the edge of the partition 34. Moreover, the tapered notch defined by the discharge funnels 78 helps to position the box 36 relative to the chute 30, this being accomplished by contact between one or both funnels 78 and the partition 74.

MODIFICATION

The invention as described above may be practiced by employing a color sensitive photocell 40 rather a photocell which is responsive to the presence or absence of a light beam. For example, a photocell that is sensitive to yellow color may be used in a position similar to photocell 40 and will be responsive to yellow light reflected from a lemon at the level selected.

I claim:

1. In apparatus for filling a box with articles from a movable conveyor, first means for driving said conveyor, a bin positioned adjacent said conveyor and having an opening for receiving said articles, diverter means for directing said articles from said conveyor through said opening into said bin, said bin having an outlet for said articles, a chute operatively associated with said bin and movable between a first position closing said outlet and a second position opening said outlet and delivering said articles to said box, second means for moving said chute between said first and second positions, and third means operatively associated with said first and second means and responsive to the filling of said bin with articles for controlling said first and second means to regulate the feeding of said articles to said bin and the discharge of articles from said bin.

2. Apparatus according to claim 1 wherein said third means is a photocell device for detecting the level of articles at said opening in said bin, responsive thereto for stopping said conveyor and for lowering said chute from upright position to receive articles from said outlet and to discharge articles therethrough to said box.

3. Apparatus according to claim 2 wherein said photocell device is adjustable to be responsive at a selected one of various levels of articles within said bin, whereby said bin may be filled to a level at which its volumetric capacity is equivalent to that of said box.

4. Apparatus according to claim 2 further including a time delay device for keeping said conveyor stopped and for holding said chute in lowered position during the discharge of articles from said bin for additional seconds after said photocell device is unobstructed by articles at the level of said opening.

5. Apparatus according to claim 2 wherein said photocell is sensitive to the color of said articles.

6. Apparatus according to claim 1 further including a diverter bar disposed at an angle to the direction of movement of articles by said conveyor for diverting articles from said conveyor through said opening into said bin.

7. Apparatus according to claim 1 further including a fourth means operatively associated with said third means and responsive to the presence of a box positioned beneath said chute for conditioning the responsiveness of said third means, whereby said third means is ineffective for actuating the discharge of articles from said bin in the absence of a box beneath said chute.

8. Apparatus according to claim 1 further including a fifth means operatively associated with said third means and responsive to the weight of a box positioned beneath said chute for conditioning the responsiveness of said third means, whereby said third means is ineffective for actuating the discharge of articles from said bin in the absence of an empty box beneath said chute.

9. Apparatus according to claim 1 further including a time delay switch which is operatively associated with said second means and is selectively operable for a period of seconds during which said articles fill said box, said time delay switch being responsive upon the expiration of said period for moving said chute back to first position.

10. Apparatus according to claim 1 further including a time delay switch which is operatively associated with said first means and is selectively operable for a period of seconds during which said articles fill said box, said time delay switch being responsive upon the expiration of said period for restarting said conveyor.

11. Apparatus according to claim 10 further including a second conveyor for boxes, means for moving one of said boxes beneath said chute, positioning means for maintaining a box in position along said second conveyor for filling by said chute and responsive to time delay switch for releasing a filled box for movement along said second conveyor away from said chute and for stopping an unfilled box moving along said second conveyor in position beneath said chute.

12. Apparatus according to claim 11 wherein said box has a center upright partition, and wherein said positioning means further includes a bifurcated outlet for said chute engageable with said partition when said chute is in second position for centering said box relative to said chute.

* * * * *